US010992088B2

(12) United States Patent
Su et al.

(10) Patent No.: US 10,992,088 B2
(45) Date of Patent: Apr. 27, 2021

(54) UNIVERSAL SERIAL BUS TYPE-C ELECTRICAL CONNECTOR HAVING A REDUCED LENGTH

(71) Applicants: FOXCONN (KUNSHAN) COMPUTER CONNECTOR CO., LTD., Kunshan (CN); FOXCONN INTERCONNECT TECHNOLOGY LIMITED, Grand Cayman (KY)

(72) Inventors: Jie Su, Huaian (CN); Jun Zhao, Huaian (CN)

(73) Assignees: FOXCONN (KUNSHAN) COMPUTER CONNECTOR CO., LTD., Kunshan (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/551,689

(22) Filed: Aug. 26, 2019

(65) Prior Publication Data

US 2020/0067243 A1 Feb. 27, 2020

(30) Foreign Application Priority Data

Aug. 25, 2018 (CN) ..... 201810976085.5

(51) Int. Cl.

| | |
|---|---|
| ***H01R 24/60*** | (2011.01) |
| ***H01R 13/6585*** | (2011.01) |
| ***H01R 13/502*** | (2006.01) |
| *H01R 107/00* | (2006.01) |
| *H01R 13/658* | (2011.01) |
| *H01R 13/6594* | (2011.01) |

(52) U.S. Cl.

CPC ..... *H01R 24/60* (2013.01); *H01R 13/502* (2013.01); *H01R 13/6585* (2013.01); *H01R 13/658* (2013.01); *H01R 13/6594* (2013.01); *H01R 2107/00* (2013.01)

(58) Field of Classification Search

CPC ..... H01R 13/6594; H01R 13/502; H01R 13/658; H01R 24/60

See application file for complete search history.

(56) References Cited

U.S. PATENT DOCUMENTS 8,070,512 B2 12/2011 Xuan et al.
9,490,579 B2 11/2016 Little et al.
(Continued)

FOREIGN PATENT DOCUMENTS

CN 205429247 8/2016

*Primary Examiner* — Tho D Ta

(74) *Attorney, Agent, or Firm* — Ming Chieh Chang; Wei Te Chung

(57) ABSTRACT

An electrical connector includes: an insulative housing having a base and a tongue, the base having a front face for abutting a front end face of a mating connector; and plural contacts arranged in an upper and lower rows and exposed respectively to an upper and lower surfaces of the tongue, wherein the insulative housing is devoid of a step between the base and the tongue, and a length measured from a front end face of the tongue to the front face of the base is about 2.85 mm A complementary electrical connector is devoid of a grounding piece in front of plural contacts thereof, and a length measured from a front end face of a shell thereof to mating points of the contacts is about 1.05 mm.

2 Claims, 12 Drawing Sheets

(56) References Cited

U.S. PATENT DOCUMENTS

| | | | | |
|---|---|---|---|---|
| 2015/0303629 | A1* | 10/2015 | MacDougall | H01R 13/6581 439/607.01 |
| 2017/0229823 | A1* | 8/2017 | Tsai | H01R 24/60 |
| 2018/0183188 | A1* | 6/2018 | Tsai | H01R 13/6585 |

* cited by examiner

UNIVERSAL SERIAL BUS TYPE-C ELECTRICAL CONNECTOR HAVING A REDUCED LENGTH

BACKGROUND OF THE INVENTION

1. Field of the Invention

The present invention relates to an electrical connector comprising an insulative housing having a base and a front tongue, and a plurality of contacts arranged in two rows exposed respectively to the tongue, wherein the insulative housing does without a step between the base and the tongue and therefore any corresponding grounding piece at the step, thereby reducing a length of the electrical connector.

2. Description of Related Art

China Patent No. 205429247 discloses an electrical connector, comprising: an insulative housing having a base and a tongue, the base having a front face for abutting a front end face of a mating connector; a plurality of contacts arranged in an upper and lower rows and exposed respectively to an upper and lower surfaces of the tongue; and a shell enclosing the insulative housing to form a receiving space, wherein the insulative housing has a step between the base and the tongue and a grounding piece is disposed at the step. In this USB (Universal Serial Bus) Type-C compliant connector, a length measured from a front end face of the tongue to the front face of the base is about 4.45 mm.

SUMMARY OF THE INVENTION

An electrical connector comprises: an insulative housing having a base and a tongue, the base having a front face for abutting a front end face of a mating connector; and plural contacts arranged in an upper and lower rows and exposed respectively to an upper and lower surfaces of the tongue, wherein the insulative housing is devoid of a step between the base and the tongue, and a length measured from a front end face of the tongue to the front face of the base is about 2.85 mm. Features of a complementary electrical connector are devoid of a grounding piece in front of plural contacts thereof, and a length measured from a front end face of a shell thereof to mating points of the contacts is about 1.05 mm.

DETAILED DESCRIPTION OF THE PREFERRED EMBODIMENT

Figure 1:
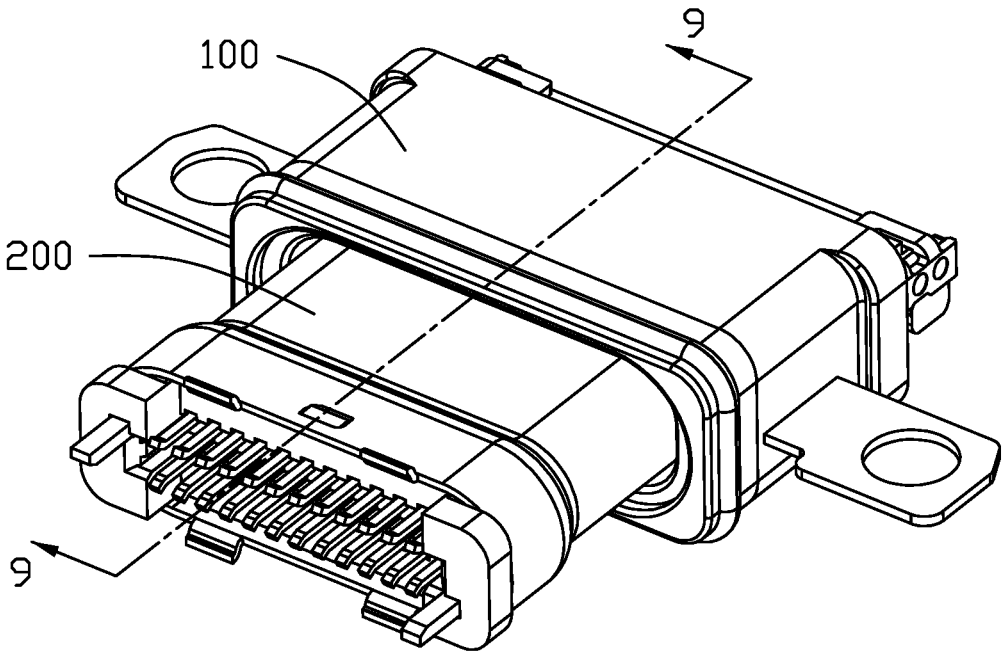
FIG. 1 is an assembled perspective view of an electrical connector assembly in accordance with the present invention.

Referring to FIGS. 1-10, a receptacle connector 100 comprises an insulative housing 1 and an upper and lower rows of contacts 2 secured to the insulative housing 1, and a metallic shell 4 enclosing the insulative housing 1. The receptacle connector 100 may further include an outer insulative shell 5 integrated with an auxiliary shell 6, a front sealing member 7, and a rear sealing member 8.

Referring to FIGS. 3-4 and 6-10, the insulative housing 1 has a base 11 and a front tongue 12. The base 11 has a front face 114. The tongue 12 has a uniform thickness. The base 11 has a pair of stoppers 111, a recess 112, and an affixing piece 113. The tongue 12 has a pair of side notches 121. The insulative housing 1 includes a first insulator 13, a second insulator 14, and a third insulator 15. The first insulator 13 has a base portion 131 and a tongue portion 132. The base portion 131 has a pair of notches 1311. The tongue portion 132 has a hole 1321. The second insulator 14 has a base portion 141 and a tongue portion 142. The base portion 141 has a pair of posts 1411 and a pair of latches 1412. The tongue portion 142 has a latch 1421. The third insulator 15 has a base portion 151 and a tongue portion 152. The affixing piece 113 fastens the base portions 131 and 141 together. The base portions 131, 141, and 151 constitute the base 11; the tongue portions 132, 142, and 152 constitute the tongue 12. A bordering line 16 is defined between the tongue 12 and the base 11. The tongue 12 extends beyond the metallic shell 4 but not beyond the insulative shell 5. In standard Type-C connector, a step is formed between its base and tongue and a grounding piece is disposed at the step, resulting in an overall length of about 4.45 mm for the step and the tongue, while the tongue itself is about 2.85 mm in length. By omitting a step in the receptacle connector 100, while keeping the tongue 12 unchanged, a reduction of 1.6 mm may be realized.

Figure 11:
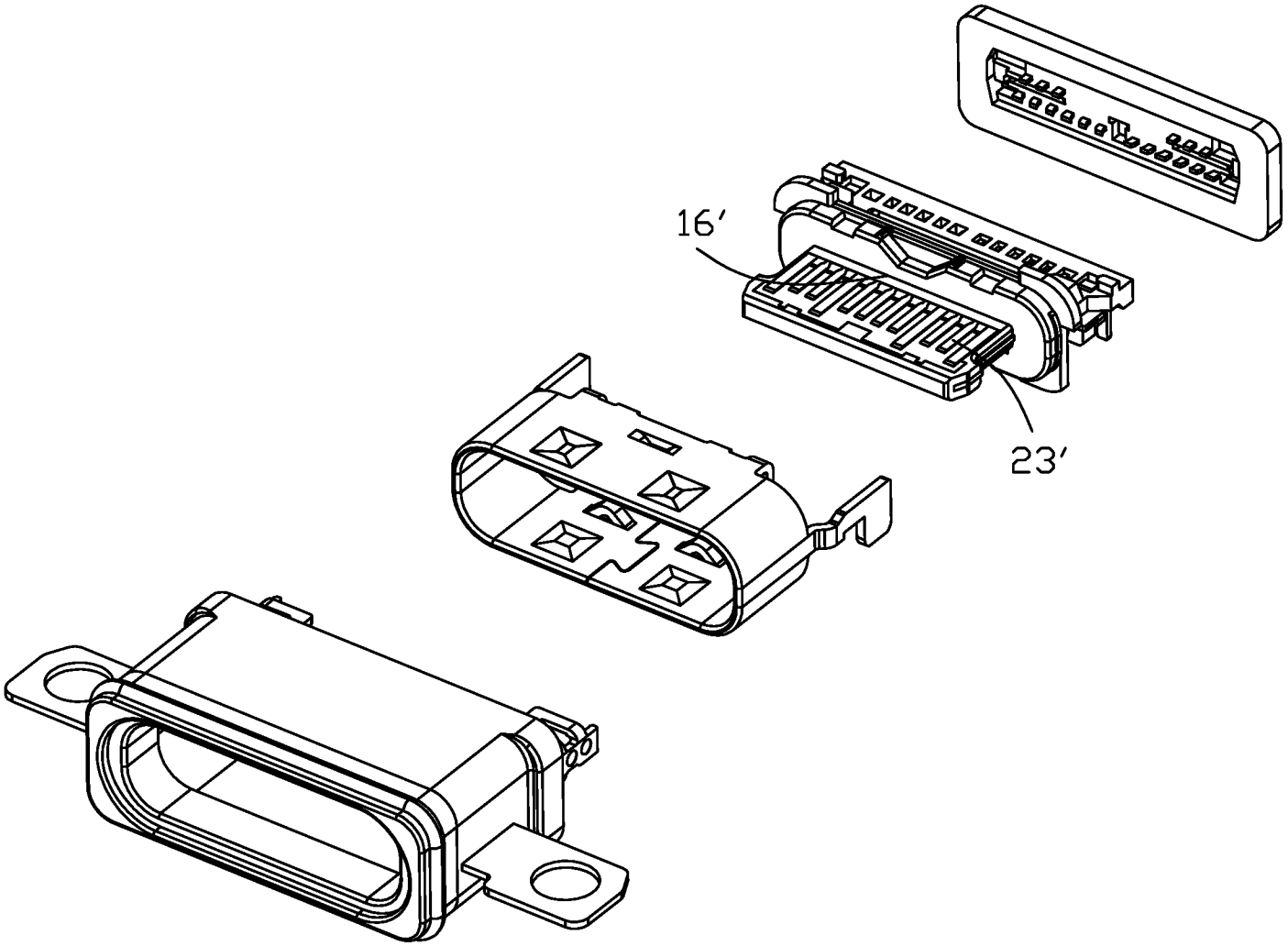
FIG. 11 is an exploded view of a varied receptacle connector.
Figure 12:
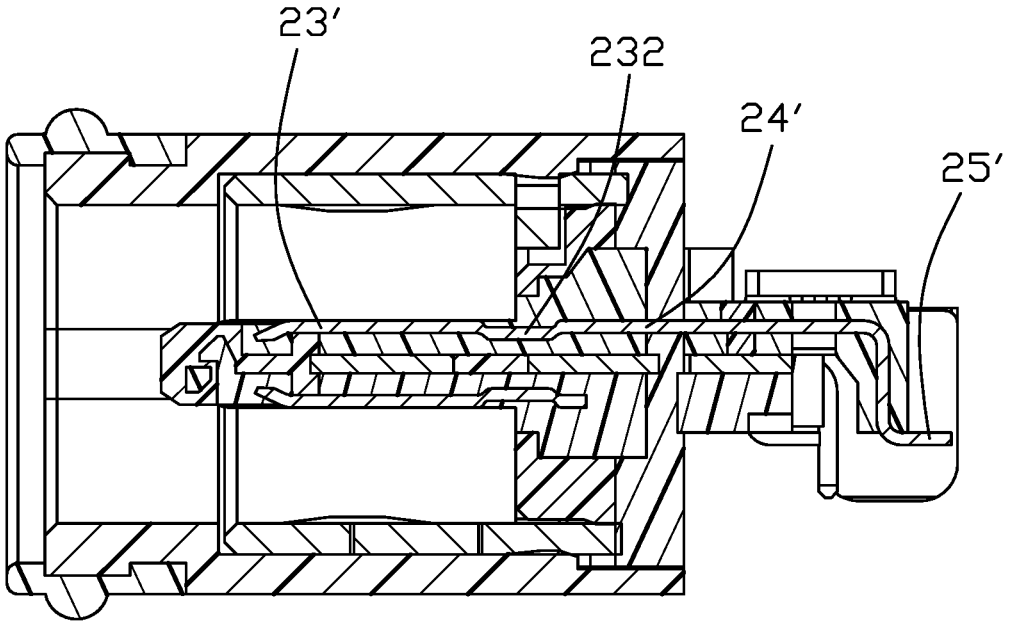
FIG. 12 is a cross-sectional view of the varied receptacle connector.

Referring to FIGS. 6-10, each of the upper row of contacts 21 and the lower row of contacts 22 has a contacting portion 23, an intermediate securing portion 24, a head 231 bent from the contacting portion 23 and embedded in the tongue portion 152 of the third insulator 15, and a soldering portion 25. The contacting portion 23 exposed and extends forward from the bordering line 16. In the varied design of FIGS. 11-12, the contact 2 has an angled portion 232 between contacting portion 23' and securing portion 24'. The angled portion 232 is near the front face of the base 11 and buried in the tongue 12.

Referring again to FIGS. 6-10, a middle shielding plate 3 is disposed between the upper row of contacts 21 and the lower row of contacts 22. The shielding plate 3 has a main part 31 and a pair of soldering legs 32.

Referring to FIGS. 1-4 and 9-10, the metallic shell 4 encloses the insulative housing 1 to form a receiving space 40. The metallic shell 4 has a top wall, a bottom wall, and two side walls. Each of the top and bottom walls has one or more stops 41; each side wall has a soldering arm 42. The tongue 12 extends forward beyond a front of the metallic shell 4. The outer insulative shell 5 defines a receiving chamber 50 and extends forward beyond a front of the tongue 12. In a top view, a distance between a front end edge of the shell 5 and a front end face of the tongue 12 along the front-to-back direction is 1.75 mm to be equal to that in the traditional receptacle connector. Also, in the top view, the distance between the front end edge of the shell 5 and the front face of the base 11 is 4.60 mm which is equal to mm 6.20 mm minus 1.60 mm wherein 6.20 mm is the distance between the front end edge of the shell and the front face of the base in the traditional receptacle connector. In other words, a dimension of the receiving space 40 of the receptacle connector 100 along the mating direction is 4.6 mm while that of the traditional receptacle connector is 6.20 mm so that the receiving space 40 is essentially only three fourths of that of the ordinary receptacle connector while still maintaining the same signal transmission format of the ordinary receptacle connector.

Figure 2:
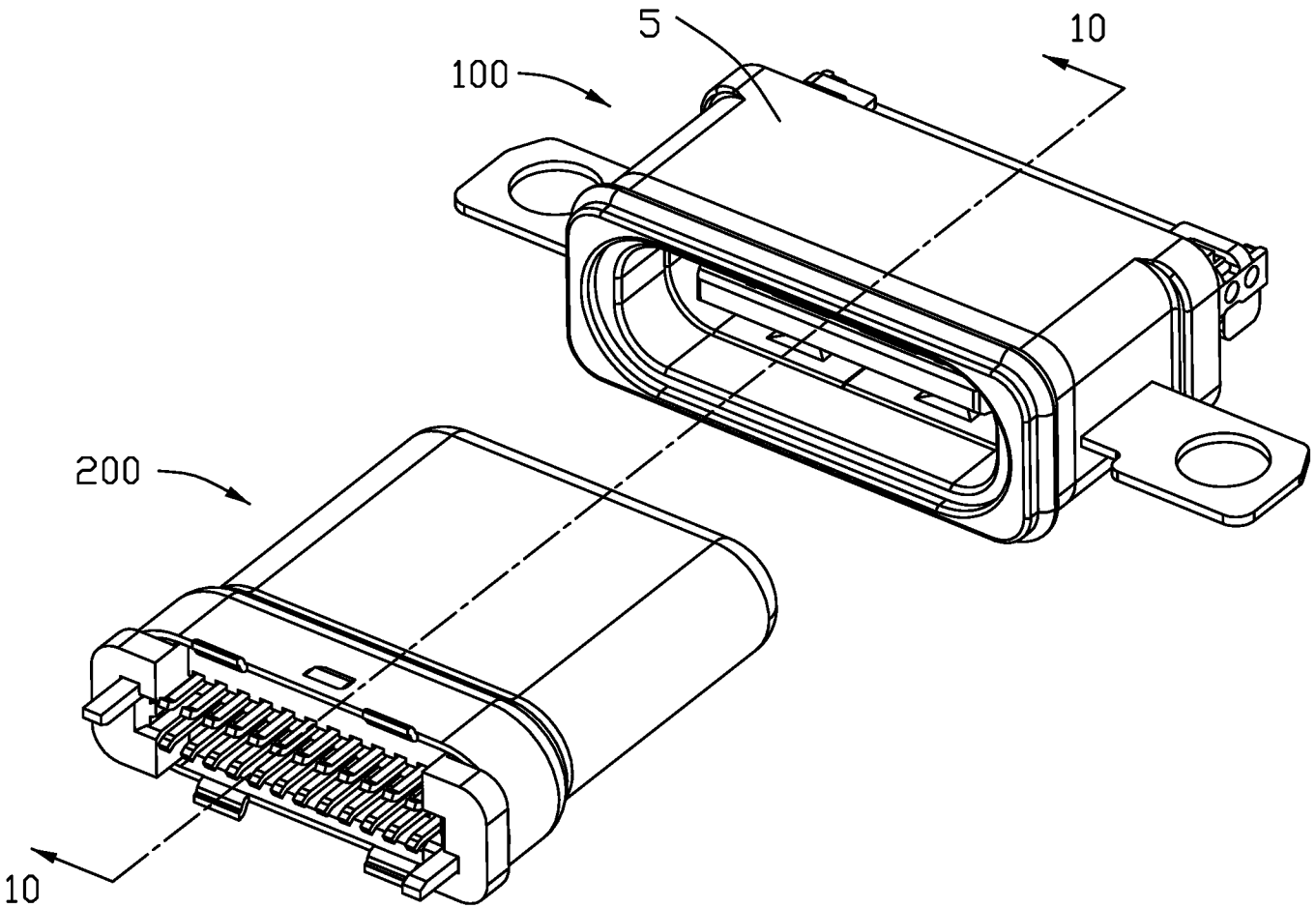
FIG. 2 is a separated perspective view of the electrical connector assembly.
Figure 3:
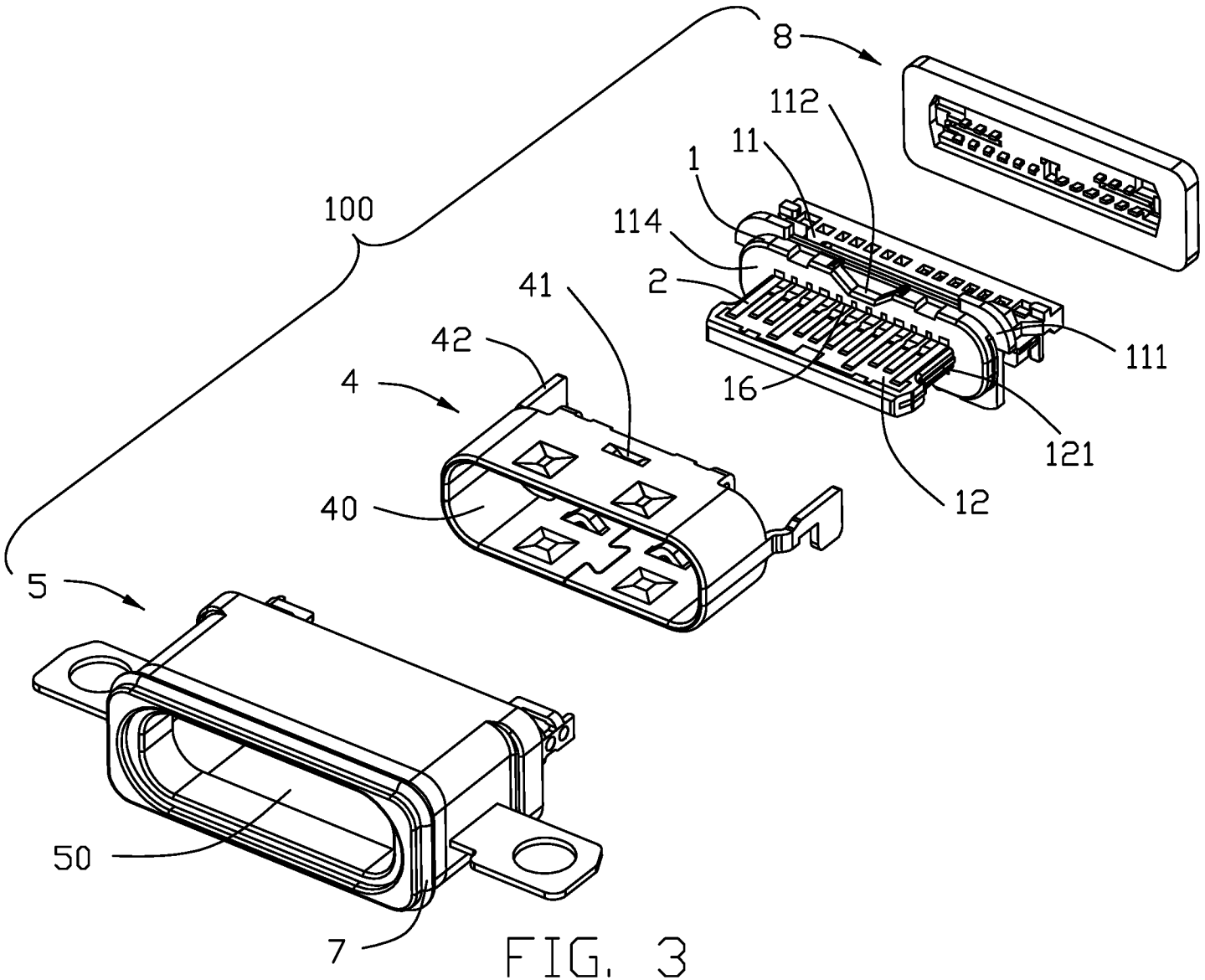
FIG. 3 is an exploded view of a receptacle connector of the electrical connector assembly.
Figure 4:
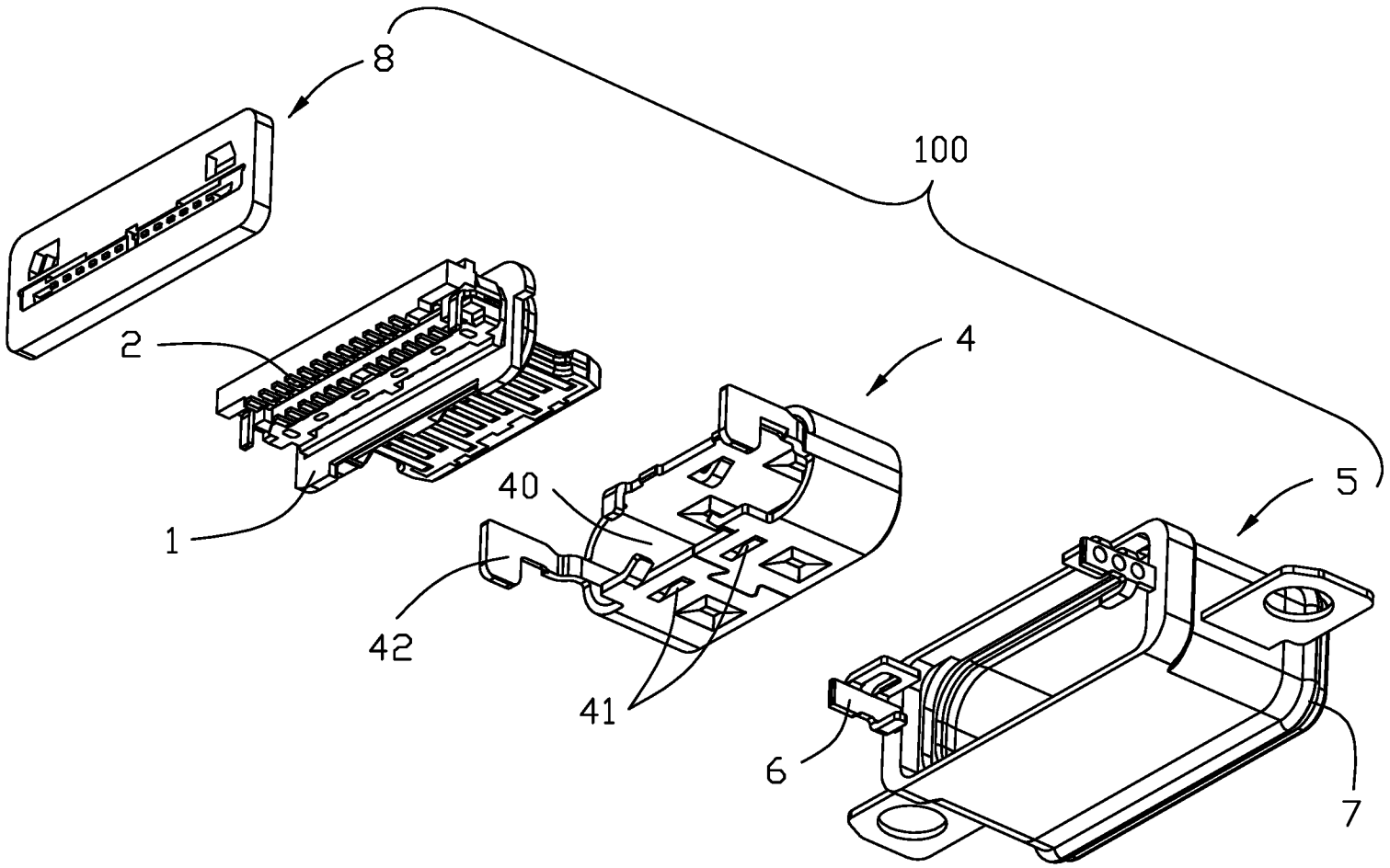
FIG. 4 is a view similar to FIG. 3 but from a different perspective.
Figure 5:
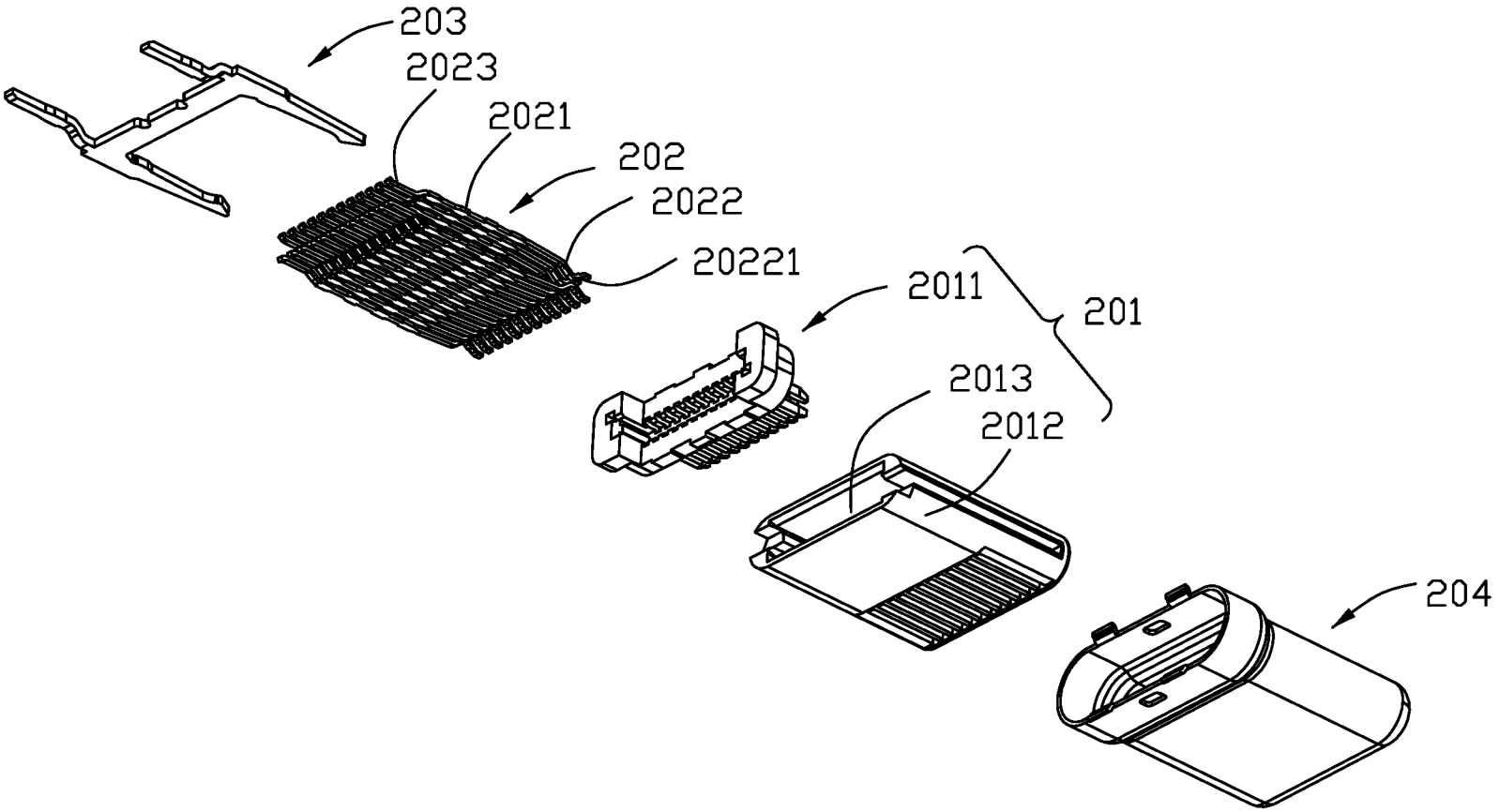
FIG. 5 is an exploded view of a plug connector of the electrical connector assembly.
Figure 6:
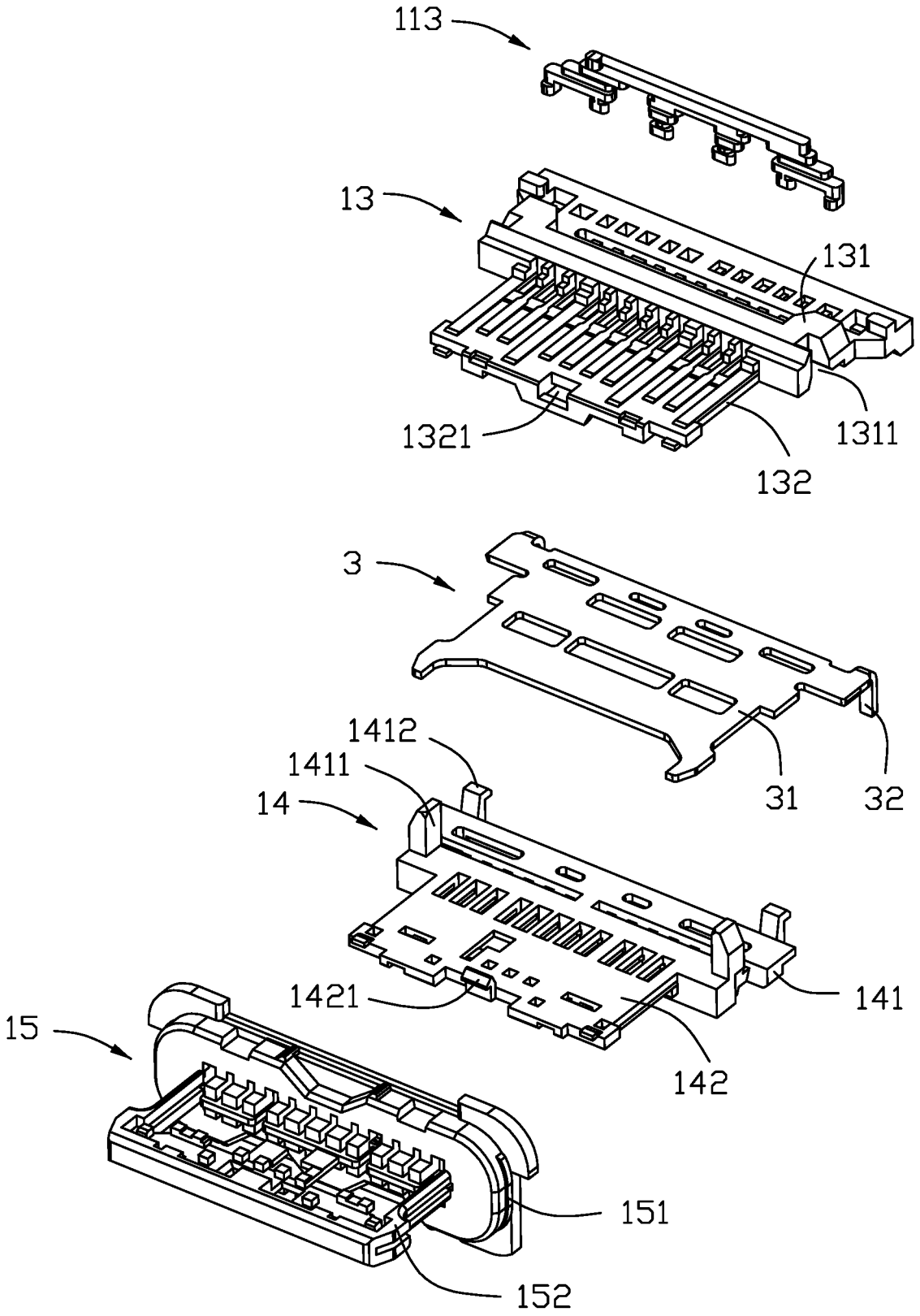
FIG. 6 is an exploded view of a contact module of the receptacle connector.
Figure 7:
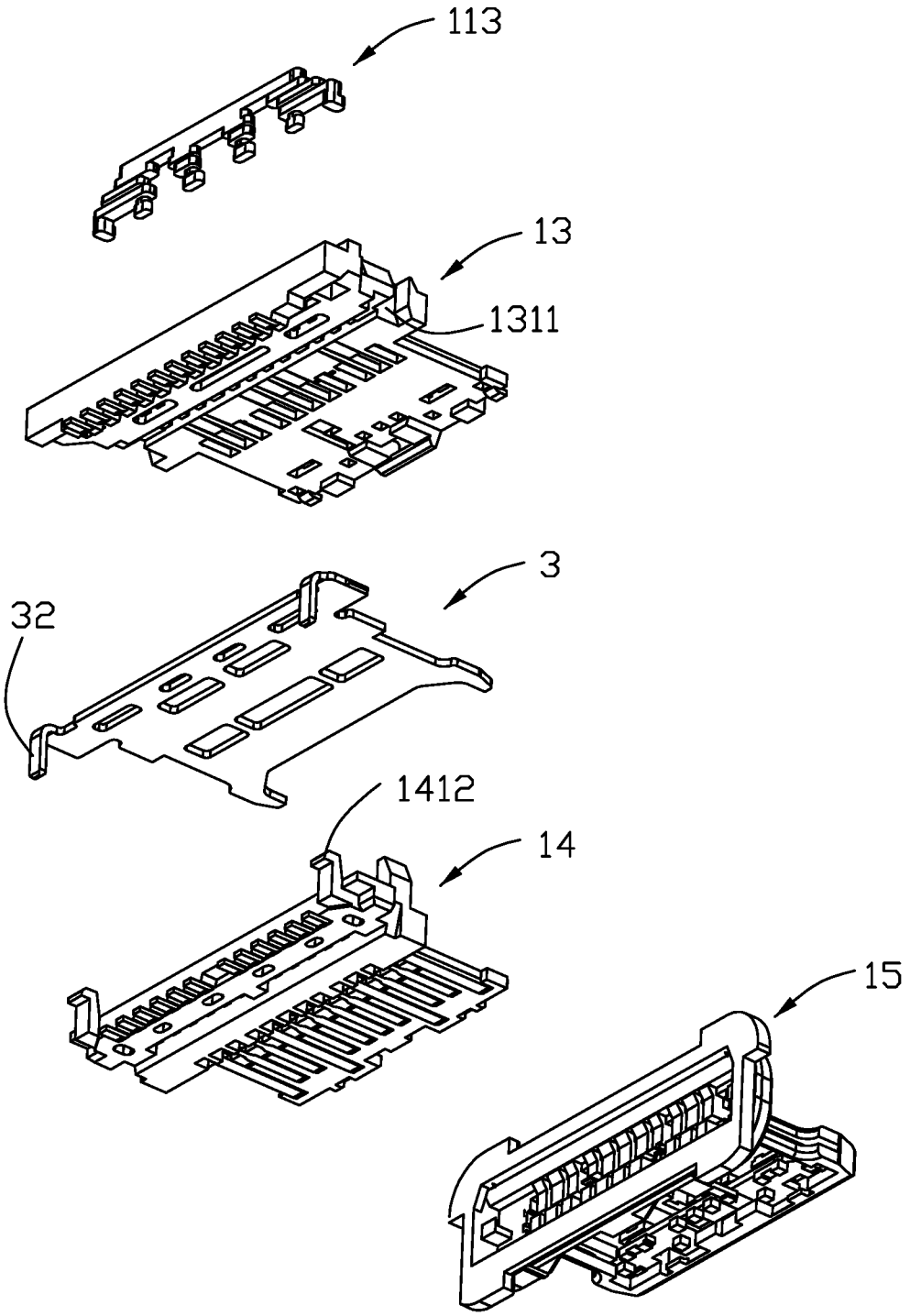
FIG. 7 is a view similar to FIG. 6 but from a different perspective.
Figure 8:
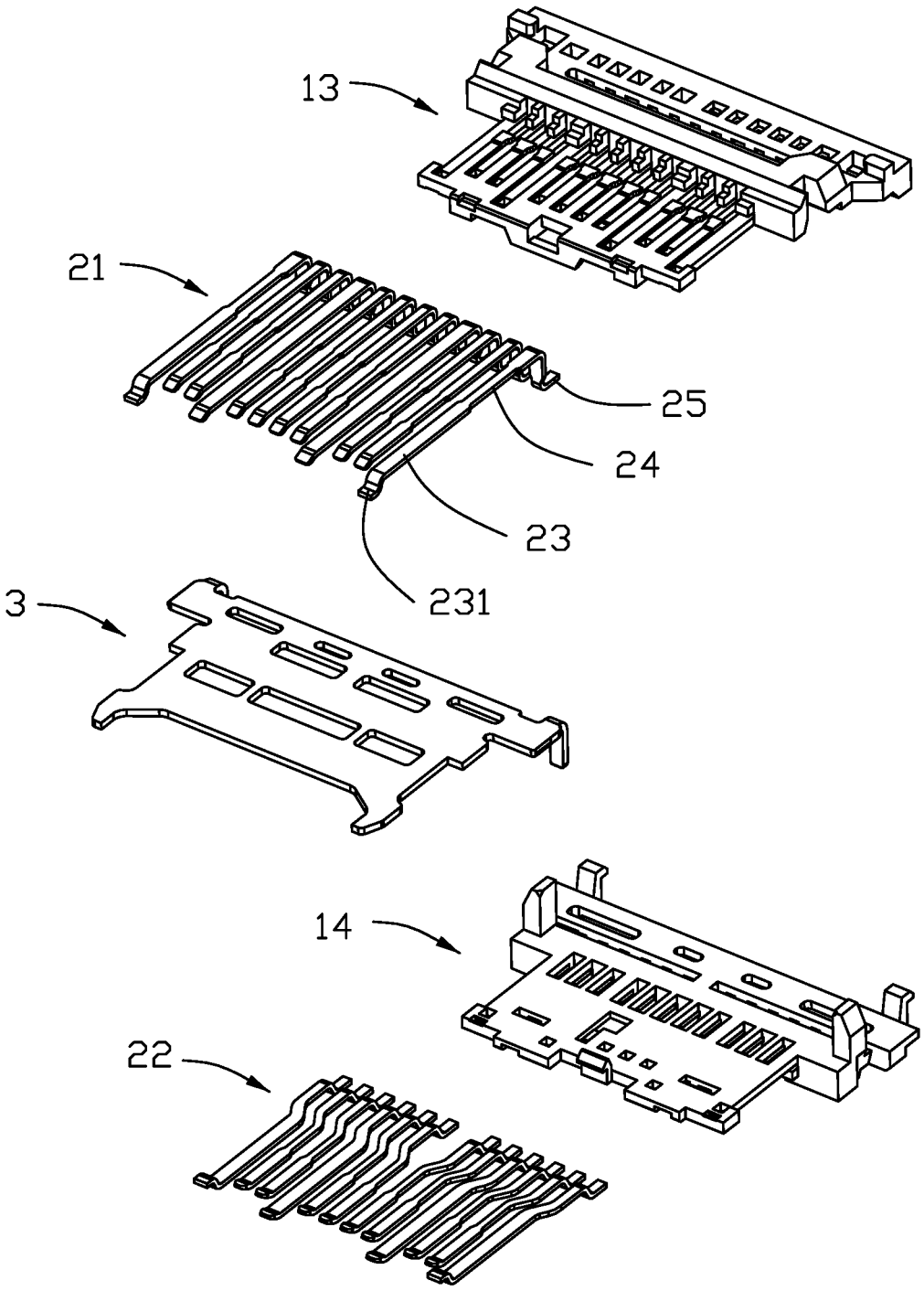
FIG. 8 is a further exploded view of the contact module.
Figure 9:
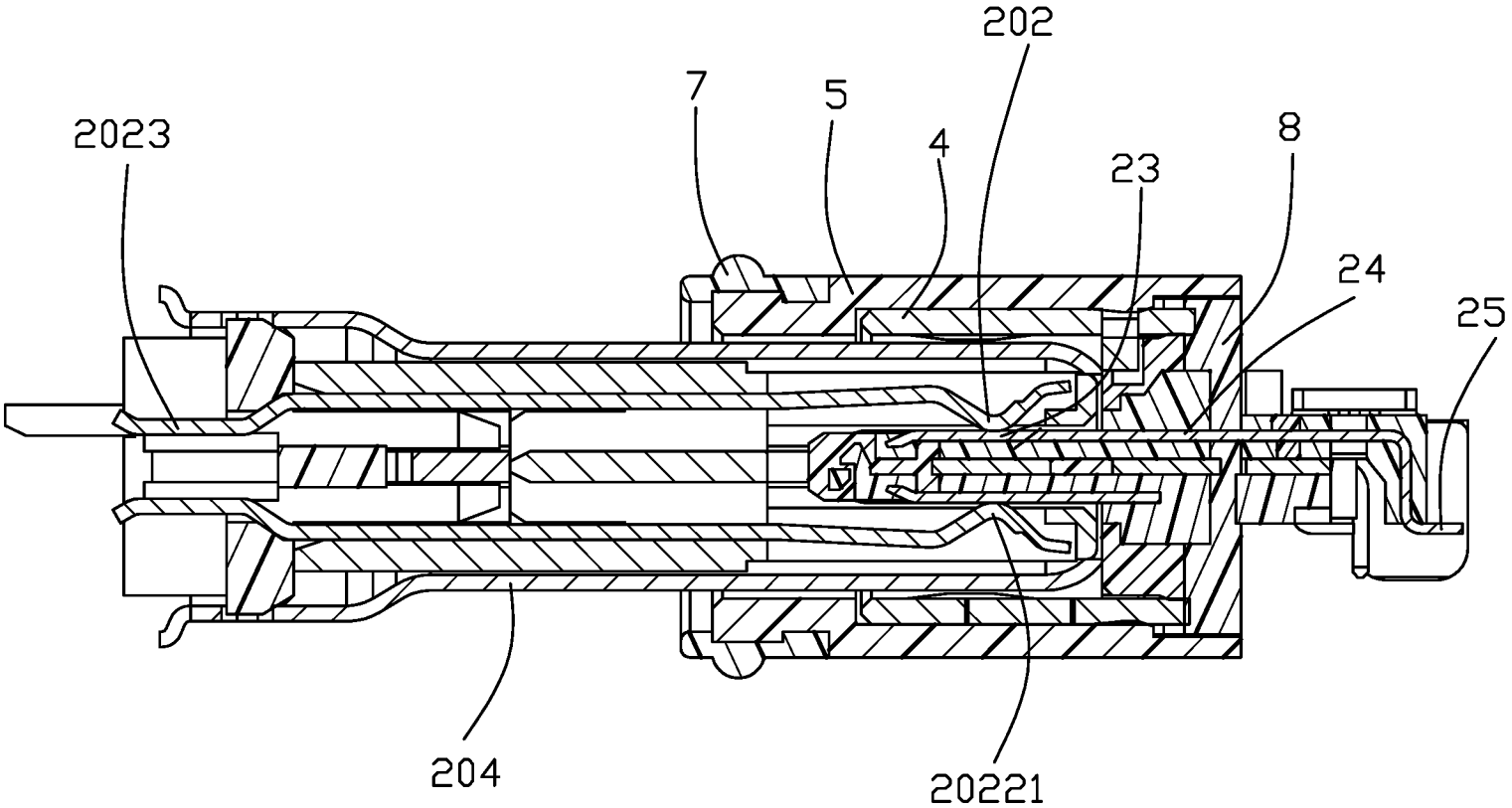
FIG. 9 is a cross-sectional view of the electrical connector assembly taken along line A-A in FIG. 1.
Figure 10:
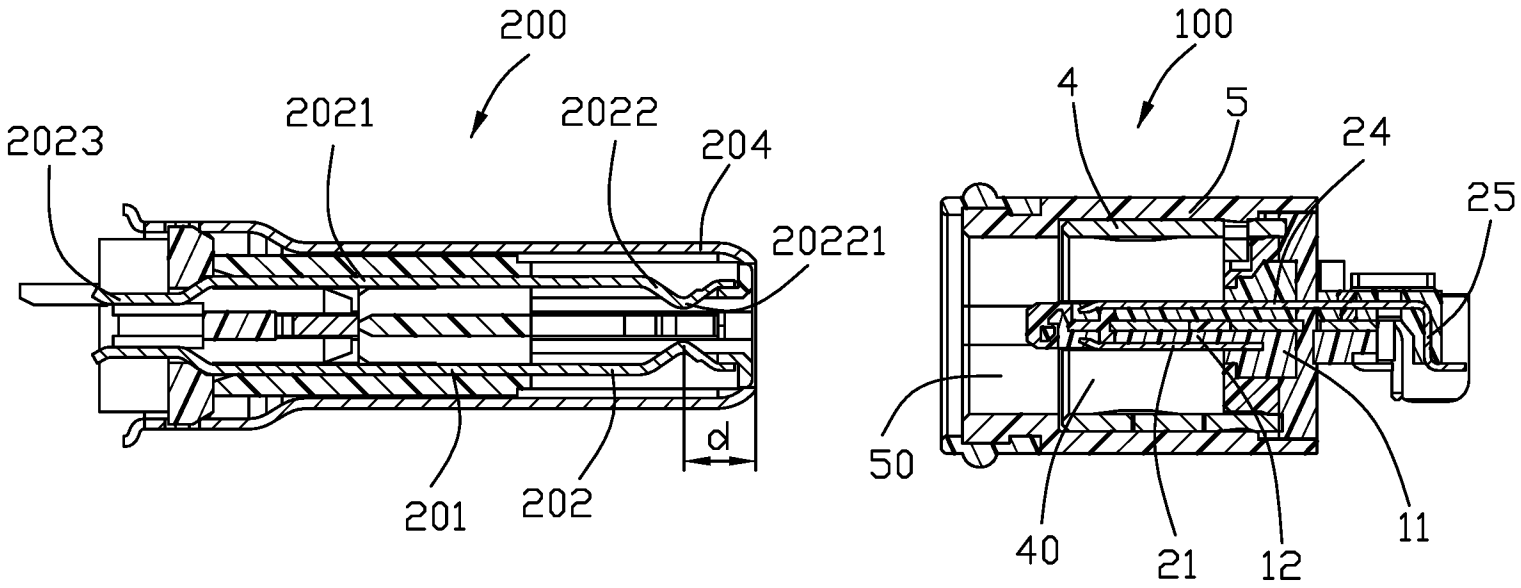
FIG. 10 is a cross-sectional view of the electrical connector assembly taken along line B-B in FIG. 2.

Referring to FIGS. 1-2 and 5, a plug connector 200 for mating with the receptacle connector 100 in dual-orientation like the USB Type-C connector assembly, comprises an insulative housing 201 having a mating cavity 2013, a plurality of contacts 202 arranged in an upper and lower rows and exposed to the mating cavity 2013, and a metallic shell 204 enclosing the insulative housing 201 and having a front face for abutting the receptacle connector 100. The plug connector 200 may further include a middle shielding plate 203 arranged between the upper and lower rows of contacts. The insulative housing 201 has a base 2011 and an inserting part 2012. Similar to the traditional USB Type-C plug connector, a front portion of the inserting part 2012 of the housing 201 defines a tongue receiving space (not labeled) to receive the tongue 12 therein so as to have the contacts 202 mated with the corresponding contacts 2 of the receptacle connector 100. The contact 202 has an intermediate securing portion 2021, a spring arm 2022, and a soldering portion 2023. The spring arm 2022 defines a mating point 20221 for making contact with the contacting portion 23. The plug connector 200 is devoid of any front grounding piece/plate in front of the plurality of contacts, which like omitting a step in the receptacle connector 100 also realizes a reduction of 1.6 mm in length of the plug connector 200 compared to ordinary USB Type-C connector. Notably, in the traditional plug connector, the contact mating point of the corresponding contact is spaced from the front end/edge of the outer metallic shell with a distance around 2.65 mm while in the instant invention, which lacks the front grounding plate, the contact mating point 20221 is spaced from the front end/edge of the outer metallic shell 204 with a distance around 1.05 mm which is equal to 2.65 mm minus 1.60 mm.

The receptacle connector 100 and the plug connector 200 of reduced lengths are intended to mate with each other in normal use. In this embodiment, the corresponding figures do not precisely show the reduced length of the plug connector. Specifically, the front narrowed inserted/mating section of the metallic shell 204 may be dimensioned with the reduced length of 5.05 mm compared with the regular length of 6.65 mm of the traditional plug connector because 6.65 mm minus 1.60 mm is equal to 5.05 mm. In case the plug connector 200 of a reduced length is inserted into an ordinary receptacle connector, the front end edge of the metallic shell of the ordinary receptacle connector is expected to abut against the expanded transition region of the metallic shell 204 behind the front mating section so as to prevent the plug connector 200 from further being inserted into the receiving space of the regular receptacle connector, so that the plug connector 200 may be stopped at the proper position along the mating direction during mating without excessive insertion and be able to mate with an ordinary receptacle connector.

In case an ordinary/traditional/standard plug connector is inserted into the receptacle connector 100 of a reduced length, since a contact mating point of such ordinary plug connector is distanced about 2.65 mm from a front end face of its outer metallic shell and exposed front ends of the contacting portions 23 are distanced about 1.80 mm-1.95 mm for the signal/regular contacts 2 and about 2.30 mm-2.45 mm for the grounding/power contacts 2 from the front face 114 of the base 11, the contact mating points of such ordinary plug connector will not touch the contacting portions 23 of the receptacle connector 100.

As disclosed in U.S. Pat. No. 9,490,579, to ensure mating of the receptacle connector 100 with the plug connector 200 only, respective identification protrusion and slot may be provided thereon so that an ordinary plug connector will not be able to insert into the receptacle connector 100, and vice versa. The feature of the invention is to provide the novel receptacle and plug connector assembly with essentially same signal transmission and similar interface with regard to the USB Type-C receptacle and plug connector assembly but having reduced length thereof for meeting the miniaturization trend wherein the possible interaction between the instant invention and the ordinary USB Type-C receptacle connector and plug connector is considered for no substantial harm thereof.

What is claimed is:

1. An electrical connector having a similar contour with a USB (Universal Serial Bus) Type-C receptacle connector, comprising:

an insulative housing having a base and a tongue, the base having a front face for abutting a front end face of a mating connector;

a plurality of contacts arranged in an upper and lower rows and exposed respectively to an upper and lower surfaces of the tongue;

a metallic shell enclosing the insulative housing to form a receiving space; and an insulative shell enclosing the metallic shell; wherein the insulative housing is devoid of a step between the base and the tongue so as to allow the tongue to intimately and directly forwardly extend from the base in a front-to-back direction to have a reduced length;

the tongue and the contacts are essentially compliant with those of the USB Type-C receptacle connector;

a length measured from a front end face of the tongue to the front face of the base is about 2.85 mm; and in a top view, a distance between a front end edge of the insulative shell and the front end face of the tongue is about 1.75 mm.

2. The electrical connector as claimed in claim 1, wherein each of the plurality of contacts has an angled portion near the front face of the base and buried in the tongue.

* * * * *